US006106340A

United States Patent [19]

Myer et al.

[11] Patent Number: 6,106,340

[45] Date of Patent: Aug. 22, 2000

[54] ELECTRICAL CONNECTOR WITH DEFLECTABLE SECONDARY

[75] Inventors: John Mark Myer, Millersville; John Raymond Shuey, Mechanicsburg, both of Pa.

[73] Assignee: The Whitaker Corporation, Wilmington, Del.

[21] Appl. No.: 09/070,004

[22] Filed: Apr. 30, 1998

[51] Int. Cl.[7] ..... H01R 13/514

[52] U.S. Cl. ..... 439/752; 439/595

[58] Field of Search ..... 439/752, 595, 439/592, 593, 586, 587, 588, 589

[56] References Cited

U.S. PATENT DOCUMENTS

| | | | |
|---|---|---|---|
| 4,583,805 | 4/1986 | Mantlik | 339/61 R |
| 4,660,915 | 4/1987 | Mantlik | 339/61 R |
| 4,758,182 | 7/1988 | Anbo et al. | 439/592 |
| 4,891,021 | 1/1990 | Hayes et al. | 439/599 |
| 4,946,398 | 8/1990 | Takenouchi et al. | 439/599 |
| 5,059,142 | 10/1991 | Ohta et al. | 439/752 |
| 5,071,373 | 12/1991 | Nagasaka et al. | 439/752 |
| 5,123,866 | 6/1992 | Endo et al. | 439/752 |
| 5,292,261 | 3/1994 | Hirano et al. | 439/752 |
| 5,435,758 | 7/1995 | Sasai et al. | 439/752 |
| 5,454,740 | 10/1995 | Sakano et al. | 439/752 |
| 5,490,802 | 2/1996 | Plyler et al. | 439/752 |

*Primary Examiner*—Gary F. Paumen
*Assistant Examiner*—Alexander Gilman

[57] ABSTRACT

An electrical connector 2 includes a connector housing 4, terminals 40 positioned in the housing 4 and a rear secondary locking member 50. Both the terminals 40 and the secondary locking member are inserted into the housing 4 through the rear end. In a prelatched configuration, the rear secondary locking member 50 provides clearance for terminal insertion. When moved forward to a latched configuration, deflectable tongues 74 engage the terminals 40 from behind to either move the terminals 40 to a fully inserted position or to prevent removal of properly inserted terminal 40. The deflectable tongues 74 include slots in the tongues into which internal housing wall 12 extend when the tongues 74 are inwardly deflected to provide resistance to extraction forces applied to the terminals 40 through wires. The tongues 74 are joined to a locking member body 52 by a thinner connecting section 86 and the rear secondary locking member 50 can be molded by straight pull mold tooling.

25 Claims, 6 Drawing Sheets

ELECTRICAL CONNECTOR WITH DEFLECTABLE SECONDARY

BACKGROUND OF THE INVENTION

1. Field of the Invention

This invention is related to electrical connectors in which a shiftable member can be inserted into the connector to either provide additional assurance that terminals are properly positioned or seated in the connector housing or can be used to move the terminal into a fully inserted position. More particularly this invention is related to an electrical connector that includes rear secondary locking.

2. Description of the Prior Art

Secondary locks insertable through the rear of an electrical connector have been employed to provide an additional locking surface to secure terminals into a connector housing and to push partially inserted terminals into a fully inserted position. One patent showing a secondary lock of this type is U.S. Pat. No. 5,891,021.

Another type of rear or auxiliary locking member is represented by the connectors shown in U.S. Pat. No. 4,946,398; U.S. Pat. No. 5,059,142; U.S. Pat. No. 5,071,373; and U.S. Pat. No. 5,292,261. Each of these patents show an electrical connector in which forwardly projecting fingers on a rear auxiliary locking member are deflected inwardly into engagement with terminals by an inclined surface on the main connector housing. Each of these four prior art patents show a series of relatively thin fingers that project forward from a rear body frame. U.S. Pat. No. 5,059,142 and U.S. Pat. No. 5,071,373 show fingers extending forward from a frame having individual terminal openings and extending into individual housing cavities formed by four walls. The other two connectors employ relatively long and thin detaining fingers. In each case the rear auxiliary locking members are held in position only by latches engaging the sides of the main connector housing. The long thin detaining fingers would be subjected to relatively large stresses induced by column loads when an extraction force would be applied to the terminals or if they are used to push the terminals into the connector housing.

The requirement that excessive stress not be placed on a rear secondary locking member or on a rear secondary lock dictates that the cross sectional area of conventional detaining fingers be as large as possible. This requirement is at odds with the requirement that thin detaining members and thin housing walls be used to reduce the overall size of the connector. For the prior art gaps, providing clearance for the housing walls, must be placed between the detaining fingers and the rear frame member from which they extend, at least in part because the frame is not inserted into the housing. These detaining fingers must then extend from the rear end of the housing to a surface on the terminals engaged by the detaining fingers, or in some cases the depth of the rear frame received within the housing is relatively small.

SUMMARY OF THE INVENTION

The instant invention provides rear secondary locking for terminals positioned in an electrical connector in a relatively small configuration in which the secondary locking member acts with the housing walls to resist relatively large extraction forces.

This electrical connector with rear secondary locking includes an electrical connector housing with a plurality of terminal cavities. Terminals are inserted into the terminal cavities from the rear. A rear secondary locking member is insertable behind the terminals positioned in terminal cavities. The rear secondary locking member includes a molded hinged projection or tongue extending forward from a molded rear body. The hinged projection is joined to the rear body by a connecting hinge section having a thickness less than the thickness of the hinged projection. The hinged projection is therefore deflectable relative to the rear body into a position behind the terminals to lock the terminals in the housing.

This electrical connector is intended for use with multiple wires to which the terminals are attached. The housing has multiple terminal cavities extending inwardly from one end of the housing. Adjacent cavities are separated by internal walls between cavities. The rear secondary locking member or locking member is insertable into the rear end of the housing, and the locking member includes locking segments or tongues inwardly deflectable upon insertion of the locking member into the housing into a position preventing removal of the terminals through the rear end. The locking segment has slots and the internal walls are received in the slots when the locking segment is deflected.

The electrical connector has multiple rows of cavities extending from a rear end to a mating end into which the terminals are inserted from the rear. Housing latches in the cavities secure the terminals in the housing. The rear secondary locking member or auxiliary locking member is insertable into the housing through the rear end. This auxiliary locking member has a body with peripheral walls with deflectable tongues extending from peripheral walls at the top and the bottom of the body. The auxiliary locking member is shiftable between a prelatched position, in which the tongues are positioned to permit insertion of terminals and a latched position in which the auxiliary locking member serves as a rear secondary locking member.

By employing a thin connecting section that allows the tongues to deflect and by employing slots in the tongues into which the internal cavity walls are received, the walls can support the deflectable tongues to increase the strength and at the same time limit the size of these individual features. Both the connector housing and the rear secondary locking member can be easily and relatively inexpensively molded. The housing walls are also continuous at their base so that gaps that allow a relatively short arcing path between adjacent contacts can be eliminated.

DETAILED DESCRIPTION OF THE PREFERRED EMBODIMENTS

Figure 1:
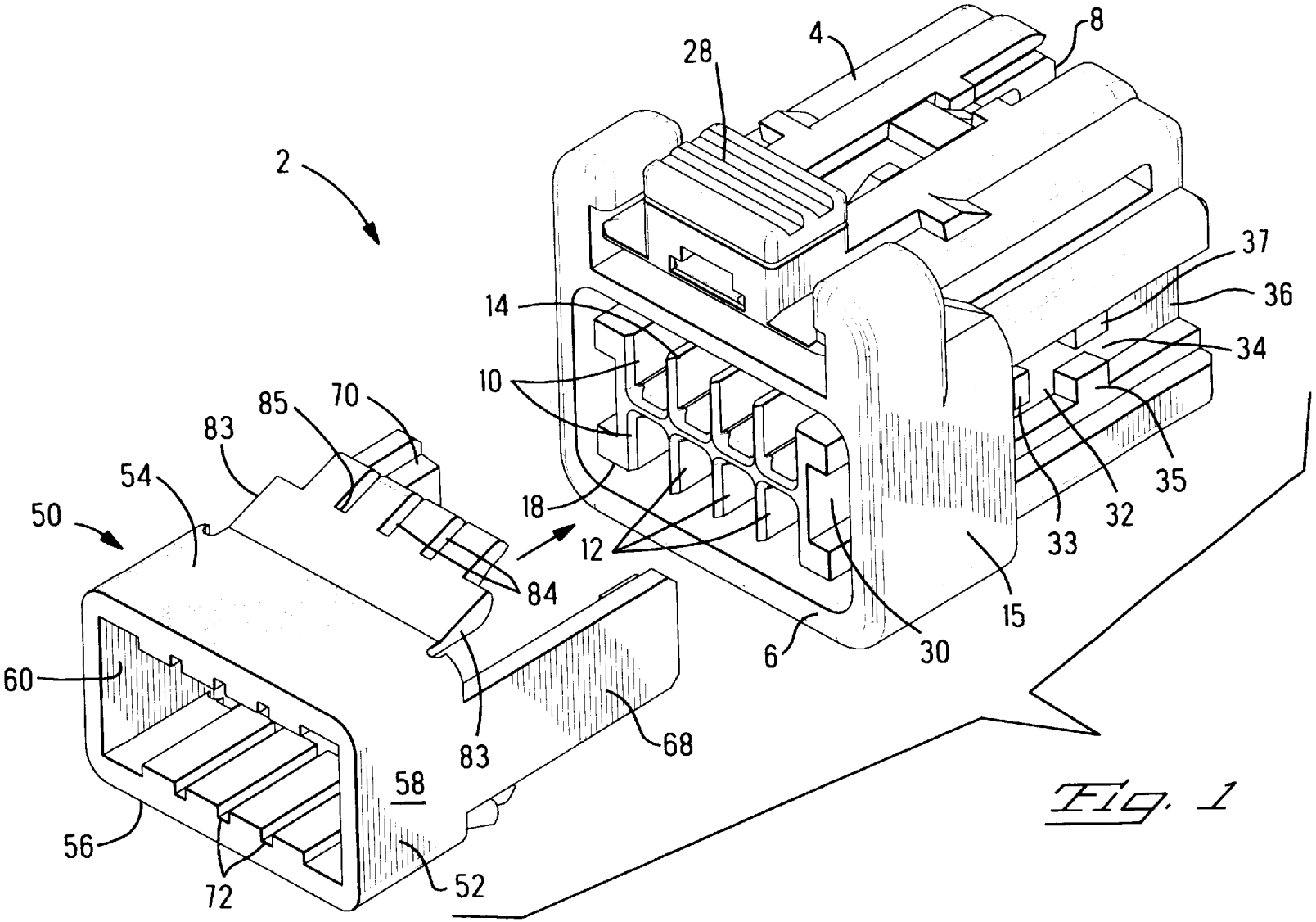
FIG. 1 is an exploded perspective view of an unassembled electrical connector showing a connector housing and rear secondary locking member.

The preferred embodiment of the electrical connector 2 shown in FIGS. 1–6 is a two row receptacle connector that can be mated to a mating plug connector of conventional construction. The electrical connector 2 includes a main connector housing 4, a rear secondary locking member 50 and terminals 40, one of which is shown for purposes of representation. The terminals 40 are inserted into terminal cavities 10 in the housing through the rear end 6 of the housing when the rear secondary locking member is in the prelatched configuration shown in FIGS. 3 and 4. Both the housing 2 and the rear secondary locking member 50 are molded from a conventional thermoplastic, such as PBT.

The connector housing 4 has a rear end 6 and a mating end 8 with terminals cavities 10 extending between the two ends. In the embodiment shown in FIGS. 1–6, the terminal cavities 10 are located in two rows and an eight position connector is shown as representative of this connector. Adjacent cavities 10 in each row are separated by internal walls 12 that extend vertically from a central web. In the preferred embodiment of this invention the thickness of these walls 12 is 0.020 inches. The top edges 14 of these walls 12 are separated from the exterior section 15 of the housing 4 by channels 18 at the top and bottom of the housing 4. These channels 18 are open on the rear of the housing 4. At the inner end, these walls 12 merge with inclined ramp surfaces 26 at the rear of the molded terminal latches 24.

The housing 4 also includes molded latches 24 in the form of deflectable cantilever beams that extend forwardly from top and bottom wall portions of the housing section 15. These latches 24 are integrally molded sections of the housing 4, and they extend into the individual cavities 10 so that they will form the primary means of securing terminal 40 inserted into cavities 24 through the open rear end 6 of the housing 4. An inclined ramping surface 26 extends along the base of each latch 24 forming a portion of the exterior of each of the cavities 10. These inclined ramping surfaces 26 face rearward toward the open rear end 6 of the connector housing.

Side passages 30 are located along each side of the rows of terminal cavities 24 and the internal walls 12. These side passages 30 extend between the ends of the terminal rows and the exterior housing section 15. Housing section 15 extends from the rear housing end 6 toward the mating housing end 8, but housing section 15 does not extend for the full length of the housing 4. The passages 30 extend completely through the housing section 15, and side passages 30 are open on both the front and the rear of housing section 15. The mating section of the housing 4 between the mating end 8 and the housing section 15 is of generally conventional configuration and is intended to mate with another connector 100, also having a generally conventional mating interface. A side channel 36 is located on each side of this housing mating section, and embossments 33, 35 and 37 are located in this side channel 36. These embossments 33, 35 and 37 form a prelatch pocket 32 located between the mating section 15 and a latching pocket 34 located closer to the mating end of the connector housing 4. Other latching configurations providing a prelatch and a latched position for two housing components are know to those skilled in the art, and the precise structure of this latching configuration is not an essential element of this invention.

Housing 4 also includes a conventional mating connector latch 28 located on the exterior of the top of the housing 4.

The terminals 40 of the preferred embodiment are conventional receptacle terminals configured to mate with conventional male terminals, such as pins or blades, located in a conventional mating connector 100. Each terminal 40 has a mating section 44 and a crimp barrel 42 which can be crimped to a wire 90 in a conventional manner. The mating receptacle section 44 also includes an opening 46 dimensioned to receive a portion of a housing terminal latch 24 when the terminal is fully inserted into the housing cavities 10. These terminals 40 can stamped and formed from a conventional spring metal, such as phosphor bronze, for example.

The rear secondary locking member or locking member 50 is dimensioned for insertion into the rear end 6 of the housing 4. Although not necessary, in the preferred embodiment the rear secondary locking member 50 is molded from the same thermoplastic as the main connector housing 4. The auxiliary locking member 50 includes a molded rear body 52 that is joined to two hinged projections or locking segments or deflectable tongues 74 that are joined to the rear body 52 by connecting hinge sections 86 that have a thickness that is less than the thickness of the walls of the rear body 52 or the projecting locking tongues 74. In the preferred embodiment of this invention, the thickness of this connecting hinge section 86 is equal to 0.020 inches at its smallest point.

The molded rear body 52 has a generally rectangular configuration and includes a top outer wall 54, a bottom outer wall 56, and two outer side walls 58, 60 joining ends of the top and bottom walls. In the two row version of this invention, an open center section 62 is formed between the four outer walls forming the rectangular rear body 52.

The deflectable projecting tongues 74 extend forward from the front edges of the top wall 54 and the bottom wall 56. Positioning and fastening arms 68 extend forward from the side walls 58 and 60. The length of these side arms 68 is greater than the length of the deflectable tongues 74, and these side arms 68 are dimensioned for insertion through the side passages 30 in the connector housing 4. Snap fastener protrusions 70 extend inwardly at the front ends of each of the arms 68. These protrusions 70 are dimensioned to fit within the prelatch pocket 32 and the latching pocket 34 on the housing 4. The arms 68 are sufficiently flexible to permit the protrusions 70 to slide over the two rear embossments 33 and 35 when a sufficient forward force is applied to the rear body 50. These protrusions 70 and the pockets 32 and 34 thus provide the means for holding the rear secondary locking member 50 in either the prelatch position shown in FIG. 3 and 4 or in the latched position shown in FIGS. 5 and 6.

The top and bottom body walls 54 and 56 include a series of grooves 72 that are wide enough to receive the top or protruding edges 14 of the internal housing walls 12 when the rear secondary locking member 50 is fully inserted into the housing 4 so that the rear of the locking member 50 is flush with the rear housing end 4.

Figure 2:
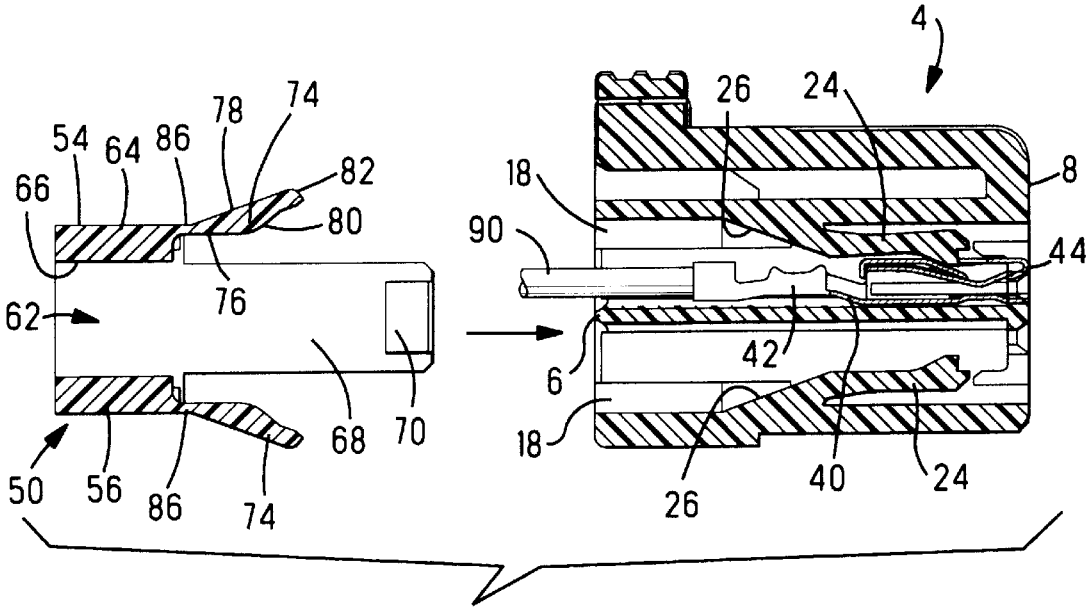
FIG. 2 is an exploded sectional view of the unassembled electrical connector components shown in FIG. 1 also showing a single terminal in one of the housing terminal cavities.
Figure 5:
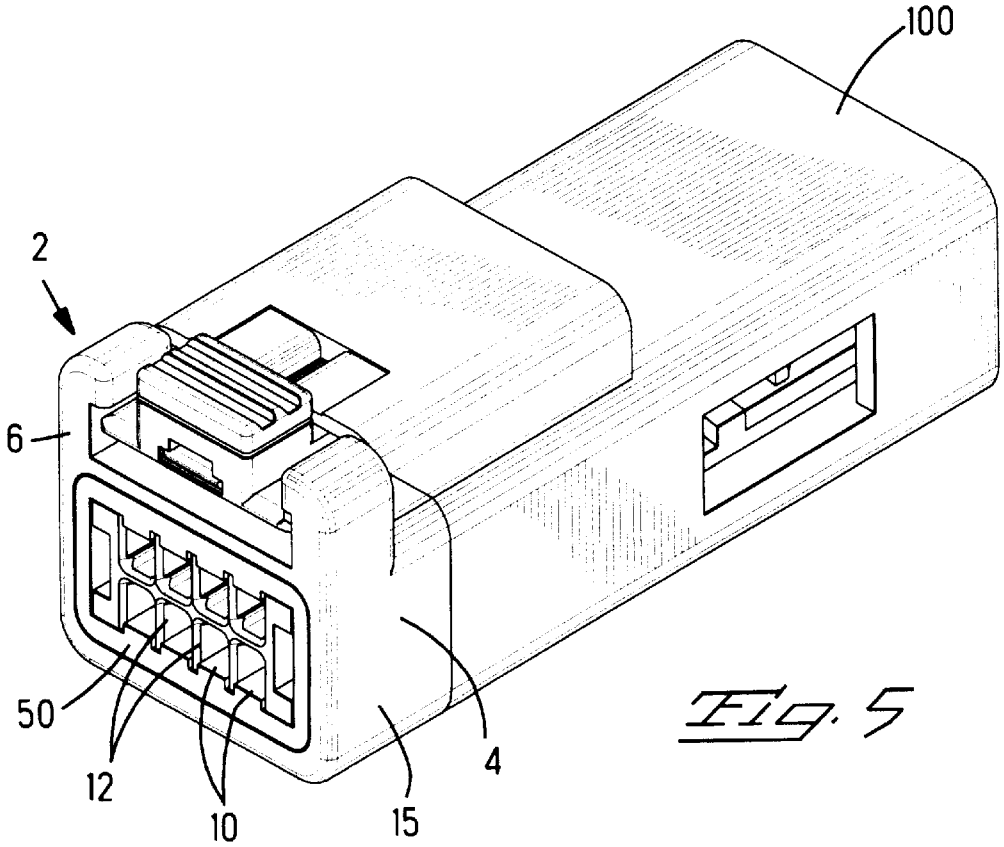
FIG. 5 is a view similar to FIGS. 1 and 3 showing the latched configuration of the connector, which is shown mated to a mating connector.
Figure 6:
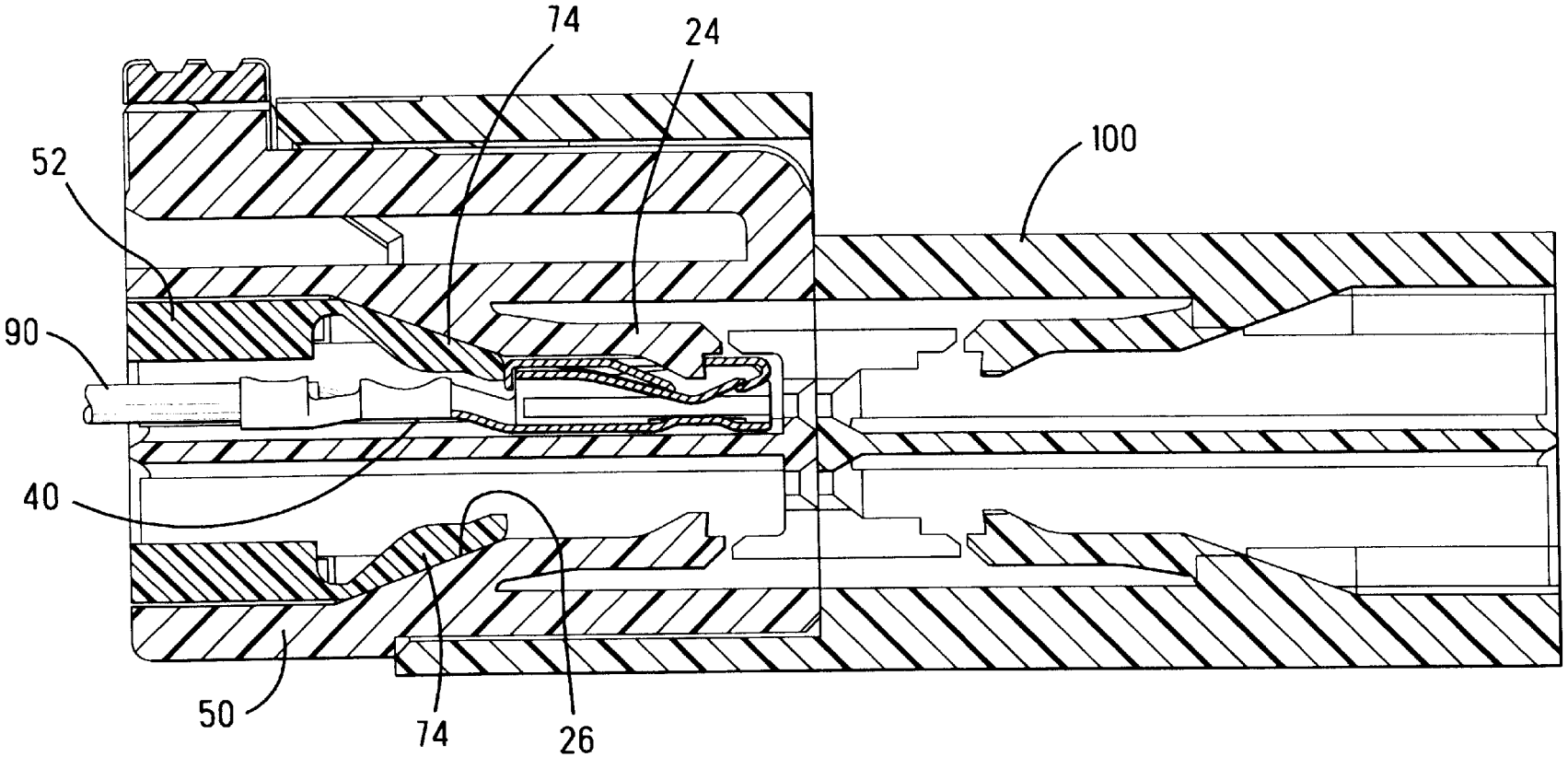
FIG. 6 is a view similar to FIGS. 2 and 4 showing the latched configuration of the connector, which is shown mated to a mating connector.

The hinged projections or tongues 74 that extend from the front of the body 52 can be deflected inwardly from the neutral unstressed position shown in FIGS. 1 and 2 to a fully inserted position shown in FIGS. 5 and 6. As shown in FIG. 2, the tongues 74 are generally triangular when viewed in a longitudinal section. The tongue 74 has a first inner surface 76 which in the neutral unstressed, or as molded, configuration extends generally parallel to the top body wall 54 and parallel to the adjacent exterior surface 64 and the adjacent interior surface 66 of the top wall 54. The outer surface 78 of the tongue 74 extends at an acute angle relative to the first inner surface 76 so that the outer surface 78 diverges relative to the first inner surface 76. The outer surface 78 extends to the remote or distal end 82 of the tongue 74. A second inner surface 80 joins the first inner surface 76 in the middle of the tongue 74, and this second inner surface 80 then intersects the outer surface 78 at the remote tongue end 82. The second inner surface 80 extends at a greater angle relative to the first inner surface 76 than the outer surface 78. As seen in FIG. 2, this second inner surface 78 is slightly concave. Each tongue 74 extends substantially the entire distance between the side walls 58, 60 at the base and the sides of the tongue 74 are scalloped at its free end so that the free end of the tongue 74 is narrower than the portion of the tongue adjacent to its base. Laterally protruding sections 83 are thus formed both sides of the tongue 74. These laterally protruding sections 83 extend from the base and end approximately half the distance between the base and the distal or free end of the tongue 74. A series of parallel slots 84 extend inwardly from the tongue free end to slot root sections 85 located near the change in the tongue width. The width of each slot 84 is slightly greater than the width of the housing internal walls 12, so that the internal walls 12 can be received in the slots 84 when the rear secondary locking member 50 is fully inserted into the housing 4 as shown in FIGS. 5 and 6.

The tongue 74 joins the body 52 at a connecting hinge section 86 that is thinner than the surrounding tongue 74 and body 50 so that the tongue can be deflected about the connecting hinge section 86. This connecting section 86 extends between the extended tongue inner surface 76 and the outer surface 78. As shown in FIG. 2, the inner surface 76 extends further into the rear body 52 than the outer surface 80, and the tongue inner surface 76 is recessed relative to the adjacent interior surface or side of the body top wall 54. Therefore the connecting hinge section 86 defines the location where the tongue 74 will be deflected relative to the molded rear body 52.

FIG. 2 shows the rear secondary locking member 50 in the configuration in which it is molded and in which it is removed from an injection mold. As is apparent from FIG. 2, supplemented by FIG. 1, none of the exterior surfaces of the locking member 50 overlap any of the interior surfaces. Furthermore, none of the surfaces facing the front of the locking member 50 overlap or are obstructed by any surfaces facing the rear of the locking member 50. This means that the locking member 50 in the configuration shown in FIGS. 1 and 2 can be molded by a straight draw or straight pull because there are no undercuts requiring any side pulls.

Figure 7:
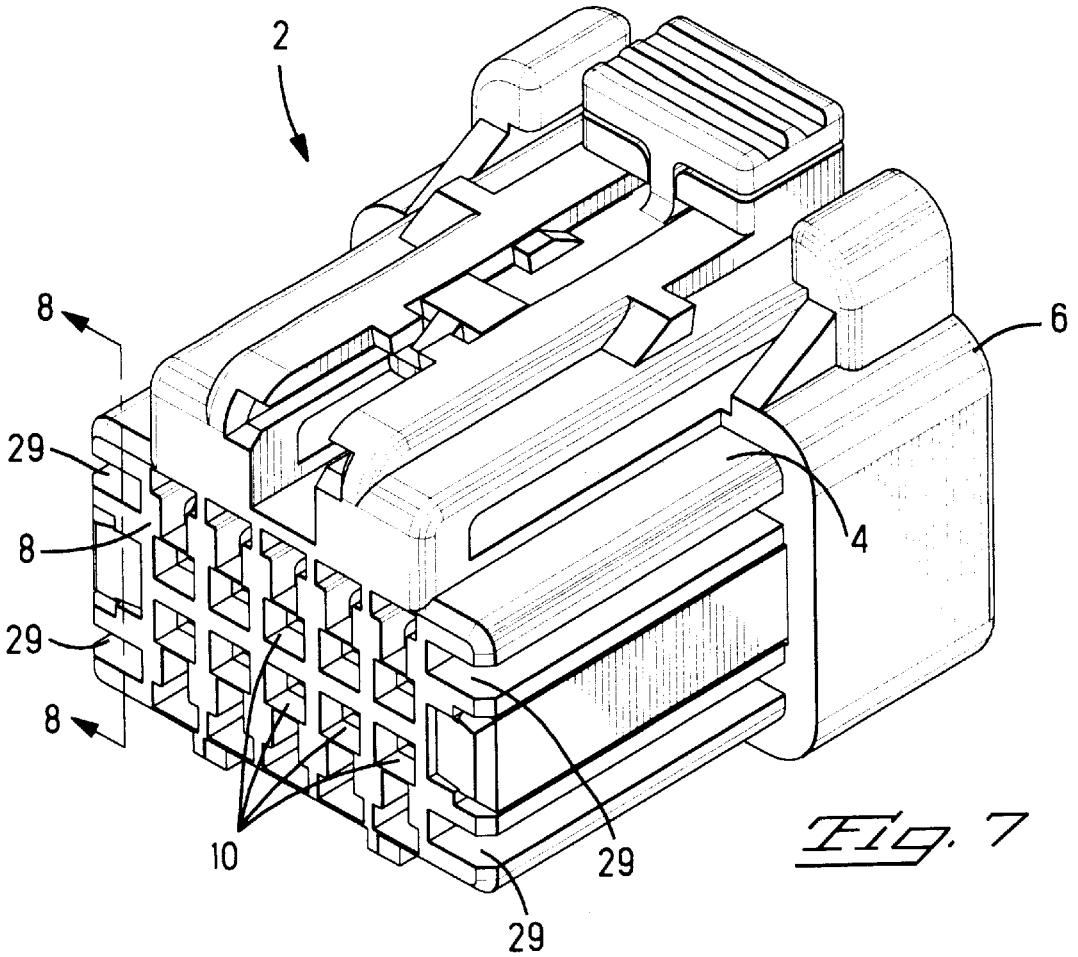
FIG. 7 is a perspective view of an alternate embodiment of this invention having ten contact receiving cavities.
Figure 8:
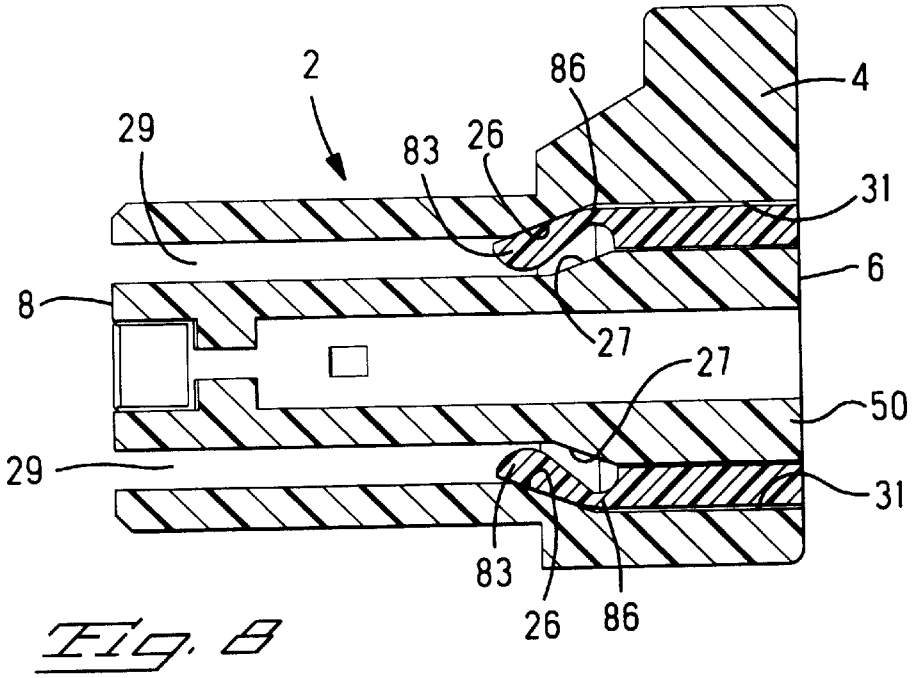
FIG. 8 is a section view taken along section lines 8—8 in FIG. 7 showing the manner in which laterally extending sections of the tongue cooperate with recesses in the housing to cam the tongue away from the terminal when it becomes necessary to remove the rear secondary locking member.

Another feature of this invention is shown in FIGS. 7 and 8 which show a slightly different version of the connector configuration shown in FIGS. 1–6, FIG. 7 shows a ten position connector, whereas FIGS. 1–6 show an eight position connector. A different latching configuration is also shown in FIG. 7. The same reference numbers are however used in FIGS. 1–8 because of the two versions of this connector differ only slightly.

FIGS. 7 and 8 show features which function to cam the tongue 74 outward away form terminals 40 when it becomes necessary to remove the secondary locking member 50 from the connecting housing 4. Four lateral recesses 29 extend rearwardly from the mating face 8 toward the rear of the connector housing. As shown in FIG. 8, these recesses 29 meet with side slots 31 which extend from the rear housing 6. The side slots 31 are slightly offset relative to the recesses 29 and an intermediate inclined section joins corresponding recesses 29 and side slots 31. An inclined camming surface 27 is formed along the interior of the intermediate inclined section. The outer surfaces of the intermediate sections comprise lateral extensions of the ramping surfaces 26. The side slots 31 have a rectangular cross section and are dimensioned to receive the laterally extending tongue sections 83 and sides of the fully inserted secondary locking member 50 as shown in FIG. 8. The recesses 29 and 31 can each be molded by mold pins that extend perpendicular to the parting face of the two mold halves which mold the housing 4, and no side pulls are necessary.

The main function of the laterally extending sections 83 is to provide a means for camming the tongues 74 outwardly when it becomes necessary to remove the secondary locking member 50 from the housing 4. The inclined surfaces 27 engage the inner faces of the laterally extending sections 83 to deflect or cam the tongue 74 away from the terminals 40 so that removal of the secondary locking member 50 does not tend to dislodge the terminals 40 from the primary housing terminal latches 24. Removal of the secondary locking member 50 may occur after plastic flow has occurred and the plastic tongue 74 and the plastic connecting hinge section 86 have taken on a permanent set. The resiliency of the hinge section 86 that was present at the time when the secondary locking member 50 was first inserted may no longer be present after the connector has been in use for a number of years, and cannot therefore be relied upon when it becomes necessary to remove the secondary locking member 50.

Although the preferred embodiment of this invention is shown in the two row connector 2 shown in FIGS. 1–6, and a slightly different version is shown in FIGS. 7 and 8, the invention is not limited to that configuration. In some respects the invention possesses additional advantages when applied to a connector having more that two rows of terminals, such as the four row connector 102 shown in FIGS. 9 and 10. For prior art connectors having more than two rows, it becomes difficult to mold complex features that provide rear secondary locking or positive lock reinforcement. However, for this invention the simple straight draw or straight pull molding that can be employed to mold both the two row connector housing 4 and the rear secondary locking member 50 can be duplicated for connectors having three or more rows.

Figure 9:
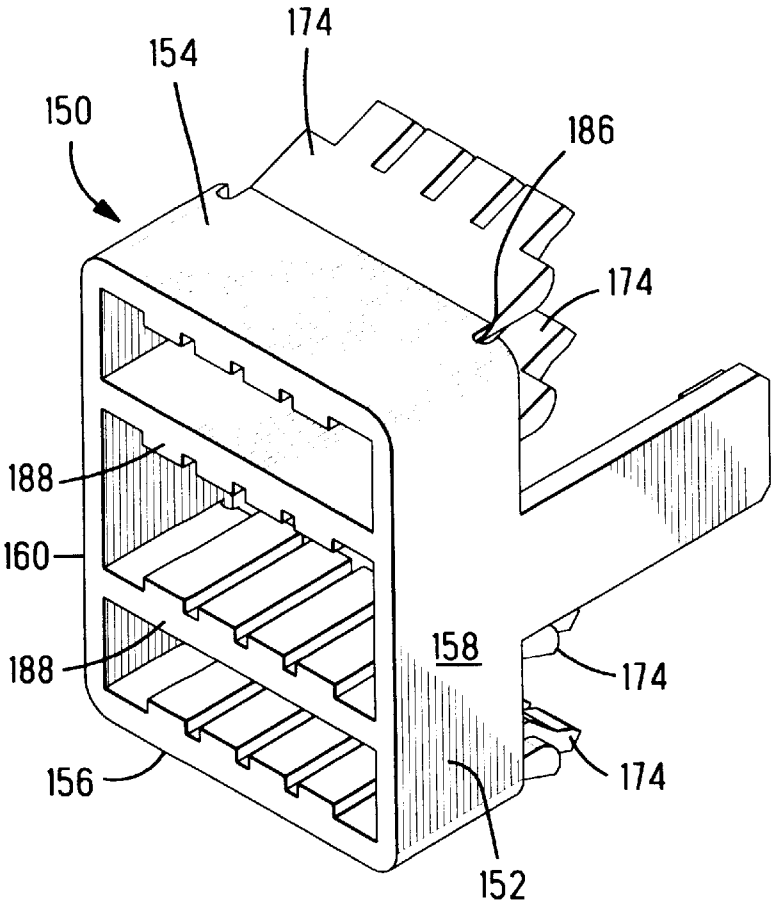
FIG. 9 is a view of a four row rear secondary locking member of an alternate embodiment.

FIG. 9 shows a four row rear positive lock member 150 in which four hinged tongues 174 having the same configuration as tongues 74 are connected to a rear locking member body 152 by thinner connecting sections 186. Of course the four row locking member 150 includes two intermediate ribs 188 extending between side walls 158 and 160. Intermediate ribs 188 are parallel to the top wall 154 and to the bottom wall 156 and are substantially identical. The deflectable tongues 174 each extend outward at an angle in the unstressed neutral position in which they are molded. There is adequate space between each intermediate rib 188 and the closest top wall 154 or bottom wall 156 to permit mold tooling to pass through the open spaces in the rear body 152 to form the outer surfaces of each deflectable tongue 174 in the same manner as for the two row locking member 50. Although the tongues 174 are somewhat obstructed in FIG. 9, the two upper tongues 174 extend upwardly from their respective connecting sections 186 and the two lower tongues 174 extend downwardly from their respective connecting sections 186 in the same manner as the tongues 74 in the two row rear secondary locking member 50 extend upward and downward.

Figure 10:
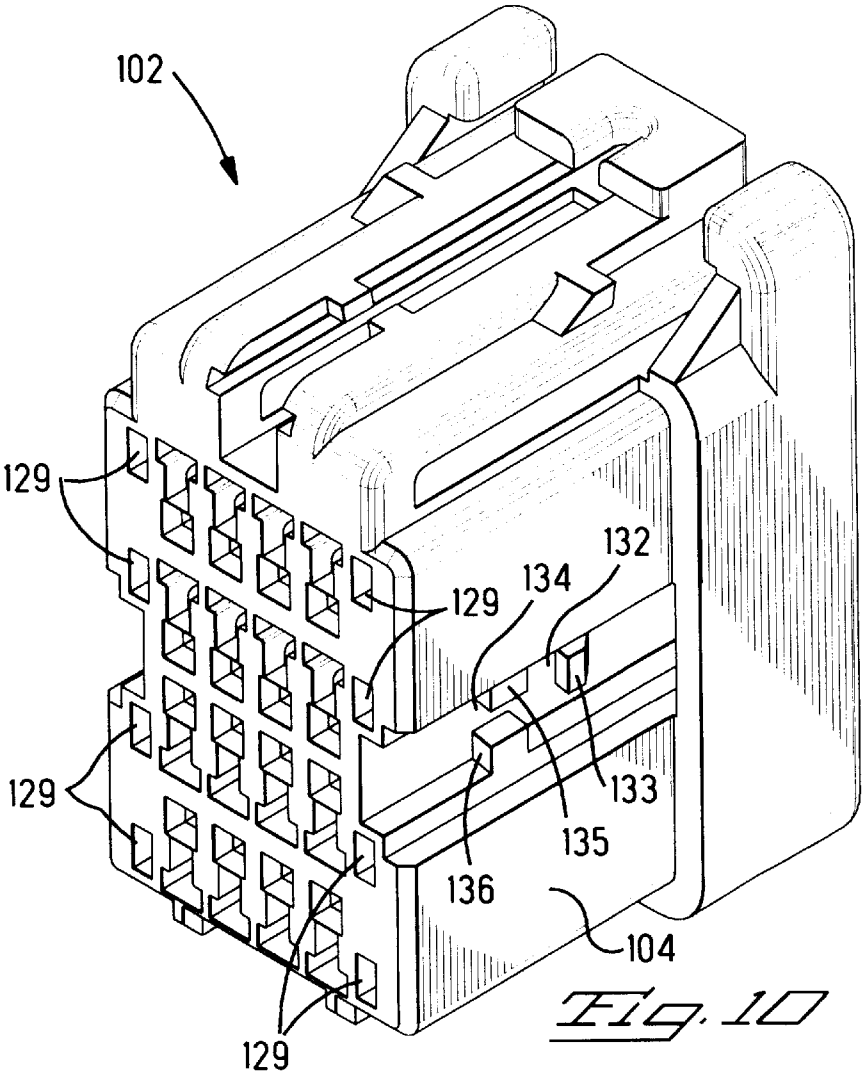
FIG. 10 is a view of the mating face of a four row connector in which the rear positive lock can be employed.

The mating face of the four row connector 102 is shown in FIG. 10. This view also shows the three embossments 133, 135 and 137 that form a prelatch pocket 132 and a latching pocket 134 in the same manner as embossments 33, 35 and 37 form pockets 32 and 34 on the two row connector. In other respects the four row connector housing 104 shown in FIG. 10 is functionally the same as the two row connector housing 4. FIG. 10 also shows that the recesses 129, which correspond to recesses 29 shown in FIGS. 7 and 8 can be enclosed on all four sides and need not be open on one side as shown in FIGS. 7 and 8.

Figure 3:
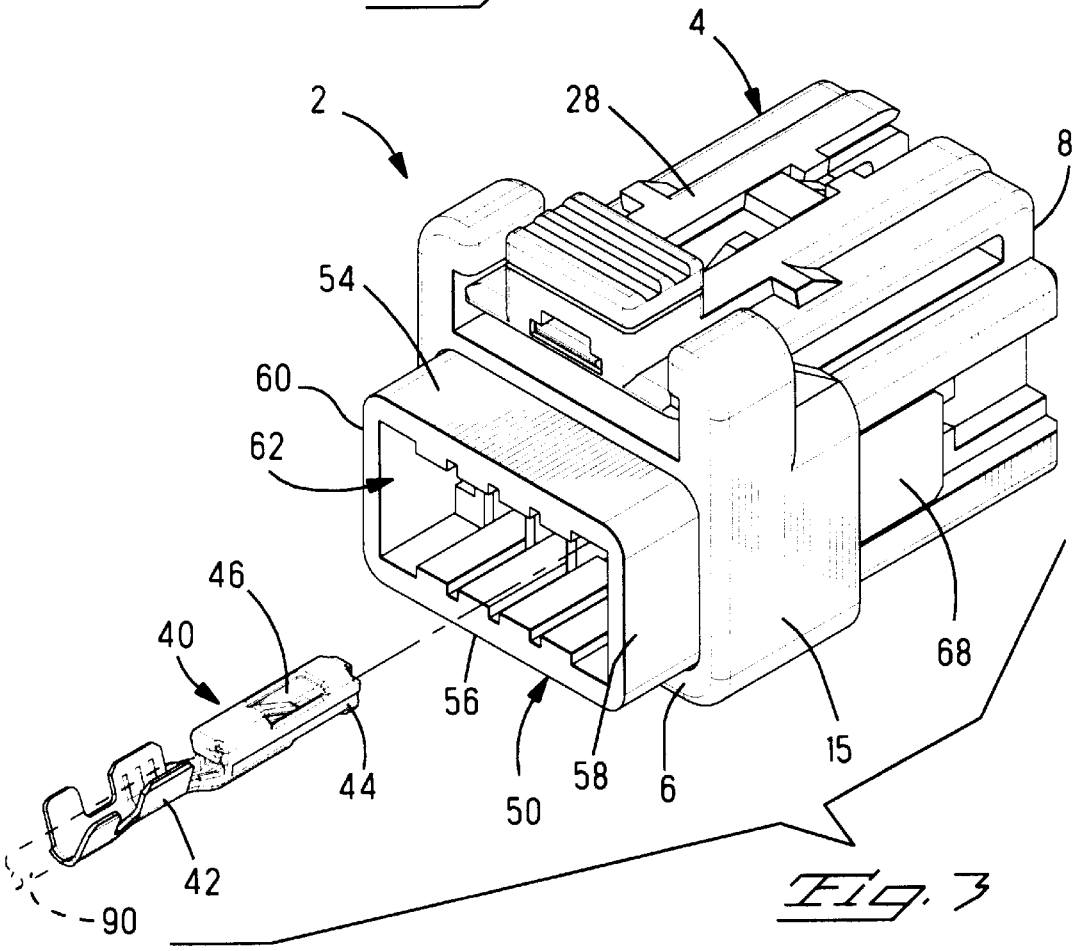
FIG. 3 is a view similar to FIG. 1 showing the rear secondary locking member partially inserted in the connector housing in a prelatched configuration.
Figure 4:
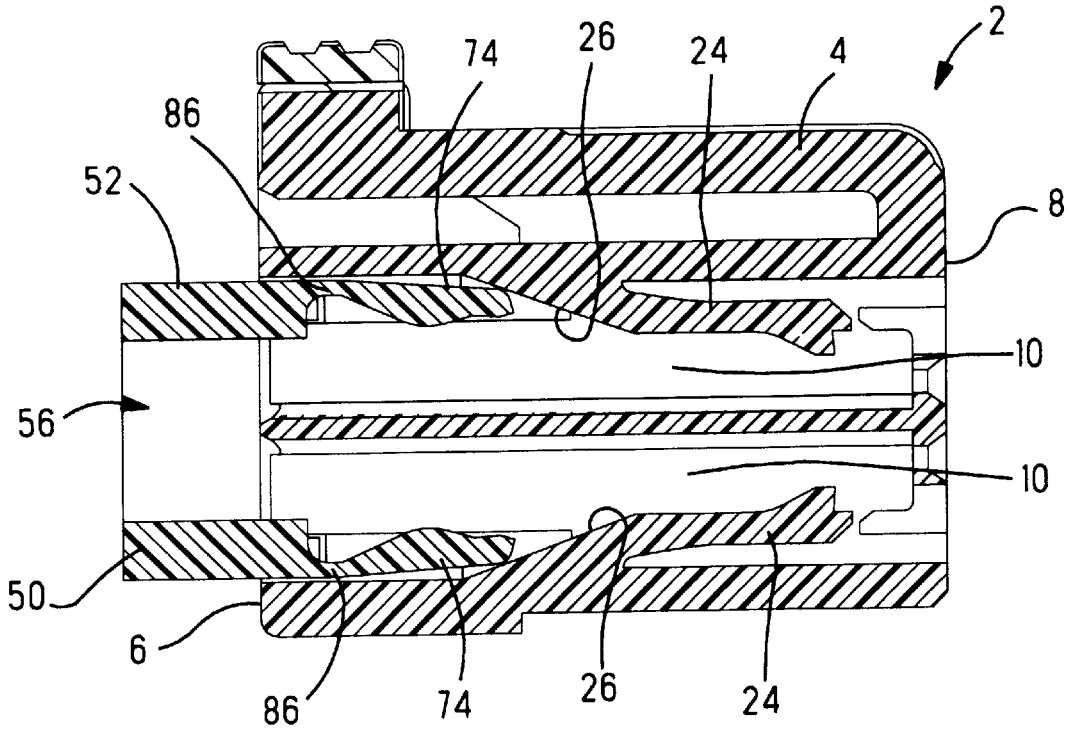
FIG. 4 is a view similar to FIG. 2 showing connector components in the prelatched configuration in which terminals can be inserted into housing terminal cavities from the rear.

The manner in which the rear secondary locking members 50 and 150 engage terminals 40 to insure that the terminals 40 are properly inserted is shown by comparing the prelatched position shown in FIGS. 3 and 4 with the latched configuration shown in FIGS. 5 and 6. The rear secondary locking member 50 is inserted into the housing 4 through the rear end 6 until the inwardly facing snap fastener protrusions 70 on both arms 68 snap into the prelatch pocket 32. In order to insert the locking member 50 into this prelatched position, the deflectable tongues 74 must be pressed inwardly until they are in alignment with the open channels 18 above and below the terminal cavities 10 and the terminal walls 12. As best shown in FIG. 4, these tongues 74 extend substantially horizontally, and they are no longer in their unstressed, as-molded, positions shown in FIGS. 1 and 2. The tongues 74 are partially deflected so that they can be inserted into terminal cavities 10 in the prelatched configuration of FIGS. 3 and 4. Therefore the terminals 40 can be inserted through the open center section 62 of the locking member 50 and through the housing rear end 6 into the terminal cavities 10. If the terminals 40 are fully inserted, the molded housing latches 24 will snap into the latching openings 46 in the terminals and the terminals 40 will be properly seated. Even if the terminals 40 are not fully inserted, the rear edge of the terminal mating section 44 can be easily positioned in front of or beyond the front end 82 of the tongues 74 when the rear secondary locking member is in the pre-latched or partially inserted position of FIGS. 3 and 4.

After the terminals 40 have been either partially or fully inserted into corresponding cavities 10, the rear secondary locking member 50 can be pushed into the latched configuration of FIGS. 5 and 6. Forward pressure on the rear locking member 50 will dislodge the protrusions 70 on arms 68 from prelatch pockets 32 and the arms 68 will deflect outward so that the snap protrusions 70 can move into the latching pockets 34. As can be seen in FIG. 5, the mating connector 100 has openings on the side which provide clearance for outward deflection of arms 68 as the rear secondary locking member 50 moves from the prelatch position to the latched position. As the locking member 50 translates into the latched position, the forward ends 82 of the deflectable tongues 74 engage the inwardly inclined ramping surfaces 26 at the rear of the molded terminal latches 24. The thinner connecting sections 86 facilitate deflection of the hinged projections 74. The tongues 74 are thus deflected behind the terminal mating sections 44. If the terminals 40 are not fully inserted, the tongues 74 engage the terminals 40 and further forward movement of the locking member 50 will cause the terminals 40 to move forward into their fully inserted positions as shown in FIGS. 5 and 6. The top or outer edges of the internal walls 12 will enter the slots 84 on the tongues 74 as the tongues 74 are deflected inwardly by the ramping surfaces 26. When the rear secondary locking member 50 is fully inserted, the top edges of the internal walls 12 will either abut the root sections 85 of the slots 84 or be proximate to the root sections. When an extraction force is applied to a terminal 40, normally by pulling a wire 90, the tongues 74 will be deflected inwardly and the internal walls 12, then in engagement with the root sections 85 of slots 84 will prevent further rearward movement of the rear secondary locking member 50, and the terminal 40. Dislodgment of the terminal 40 from the molded main terminal latch 34 will thus be prevented.

The two embodiments of this invention are intended to be representative. Detailed modifications which would be equivalent to this invention would be apparent to those skilled in the art. For example, it would be possible to mold the rear secondary locking member with undercut surfaces that would not permit straight pull or straight draw molding. Although this would eliminate one of the advantages of this invention, it would not depart from the broad definition of the invention as set forth in the following claims.

We claim:

1. An electrical connector including:

housing having multiple rows of cavities extending from a rear end to a mating end;

terminals insertable into the cavities through the rear end of the housing;

housing latches in the cavities for securing the terminals in the housing; an auxiliary locking member securing the terminals in the housing, the auxiliary locking member comprising a body having peripheral walls with a plurality of deflectable tongues, some of said tongues extending from the peripheral walls at the top and the bottom of the body, the other tongues extending from at least one internal rib parallel to the peripheral walls from which some of said deflectable tongues extend, each tongue comprising a single member extending substantially completely between opposite side peripheral walls, the auxiliary locking member being shiftable between a prelatched position, in which the tongues are positioned to permit insertion of terminals through the body into the cavities and a latched position in which the tongues are deflected inwardly behind the terminals to prevent removal of the terminals from the cavities.

2. The electrical connector of claim 1 wherein the terminals are located in two parallel rows and the auxiliary locking member body comprises a member having four peripheral walls and an open center.

3. The electrical connector of claim 1 wherein the deflectable tongues are inwardly deflected by ramping surfaces located at the rear of the housing latches.

4. The electrical connector of claim 1 wherein the individual deflectable tongues extend substantially the entire distance between side walls on the body.

5. The electrical connector of claim 1 wherein arms extend from opposite sides of the body to hold the auxiliary locking member in either the prelatched or the latched position.

6. The electrical connector of claim 1 wherein the adjacent cavities in the housing are separated by internal walls extending to the rear end of the housing.

7. The electrical connector of claim 6 wherein the internal walls extend into the body when the auxiliary locking member is in the latched position.

8. The electrical connector of claim 7 wherein the deflectable tongues include slots, the internal walls being received in the slots when the auxiliary locking member is in the latched position.

9. The electrical connector of claim 8 wherein the slots include root sections abutting the internal walls when the auxiliary member is in the latched position to prevent further inward deflection of the deflectable tongues in response to a force tending to pull the terminals out of the rear end of the housing.

10. An electrical connector with rear locking comprising:

an electrical connector housing with a plurality of terminal cavities;

terminal latches extending from the housing into the terminals cavities and an inclined surface at the rear of the terminal latches, the terminal latches extending from the inclined surface;

terminals insertable into the terminal cavities from the rear: and a rear locking member insertable behind terminals positioned behind terminals positioned in terminal cavities, the rear locking member comprising a molded hinged projection extending forward from a molded rear body, the hinged projection being joined to the rear body by a connecting hinge section having a thickness less than the thickness of the hinged projection so that the hinged projection is deflectable relative to the rear body, upon engagement with the inclined surface inwardly into engagement with the terminals, into a position behind the terminals and adjacent to the inclined surface to lock the terminals in the housing.

11. The electrical connector of claim 10 wherein the rear locking member comprises a rear secondary locking member and the housing includes primary latches engagable with the terminals.

12. The electrical connector of claim 10 wherein all inwardly facing surfaces on the rear locking member and all outwardly facing surfaces on the rear locking member are nonoverlapping when the hinged projection is in a neutral unstressed condition and all rearwardly facing surfaces do not overlap any forwardly facing surfaces so that the rear locking member can be molded by two opposed mold members movable along a straight line path in opposite directions so that the rear locking member can be molded by a straight pull without undercuts.

13. The electrical connector of claim 10 wherein the hinged projection is molded to extend beyond an adjacent exterior side of the rear body when the connecting hinge section is in a neutral unstressed condition, the hinged projection being deflected inwardly of the adjacent exterior side when the rear locking member is inserted into the connector housing.

14. The electrical connector of claim 13 wherein a longitudinal section through the hinged projection has a triangular shape.

15. The electrical connector of claim 13 wherein the hinged projection, when in neutral unstressed condition, has a first inner surface adjacent to the connecting hinge section that extends at a smaller angle relative to the adjacent exterior side of the rear body than an outer surface of the hinged projection to form a connecting hinge section that has a thickness less than that of the hinged projections.

16. The electrical connector of claim 15 wherein a second inner surface on the hinged projection extends at an angle greater than an angle between the first inner surface and the outer surface of the hinged projection so that the second inner surface intersects the outer surface at a distal end of the hinged projection.

17. The electrical connector of claim 15 wherein the first inner surface of the hinged projection lies in a plane parallel to an interior side of the body and spaced further outwardly than the interior side of the body.

18. An electrical connector for use with multiple wires, the electrical connector comprising:

multiple terminals including means for attaching wires to the terminal-s;

a housing having a plurality of terminal cavities extending inwardly from one end of the housing, adjacent cavities being separated by internal walls between cavities; and a locking member insertable into the one end of the housing, the locking member including a locking segment inwardly deflectable upon insertion of the locking member into the housing into a position preventing removal of the terminals through the one end, the locking segment having slots, the internal walls being received in the slots when the locking segment is deflected, roots of the slots abutting top edges of the internal walls when an extraction force is applied to the wires to resist removal of the locking member and extraction of the terminals.

19. The electrical connector of claim 18 wherein the internal walls are insertable into the slots only as the locking member is shifted from a prelatched to a latched configuration.

20. The electrical connector of claim 18 wherein the locking member comprises a rear secondary locking member.

21. The electrical connector of claim 18 wherein multiple terminal cavities are located in a row with an open channel extending parallel to the row, top surfaces of the internal walls extending along an inner side of the channel.

22. The electrical connector of claim 21 wherein the locking segment is deflectable until the top edges of the internal walls engage a root section of the slots to prevent further inward deflection of the locking segment.

23. The electrical connector of claim 18 wherein the locking member is insertable through a rear end of the housing opposite from a mating end of the housing.

24. The electrical connector of claim 23 wherein the locking segment extends from a front edge of an outer wall of a body having an open center section through which terminals attached to wires can be inserted.

25. An electrical connector including:

a housing having multiple rows of cavities extending from a rear end to a mating end;

terminals insertable into the cavities through the rear end of the housing;

housing latches in the cavities for securing the terminals in the housing;

a ramping surface on the housing at the rear of the housing latches;

a secondary locking member securing the terminals in the housing, the secondary locking member being insertable into the housing through the rear end;

the secondary locking member having a molded body with a deflectable tongue extending from the body, the tongue engaging the ramping surface so that the tongue is deflected inwardly behind the terminals upon insertion of the secondary locking member into the housing;

a lateral section of each tongue; and a camming surface on the housing, the camming surface being opposed to the ramping surface, the camming surface engaging the lateral section of the tongue upon removal of the secondary locking member from the connector housing to deflect the tongue away from the terminals.

* * * * *